US005973488A

United States Patent [19]

Fackler

[11] Patent Number: 5,973,488

[45] Date of Patent: Oct. 26, 1999

[54] METHOD FOR BALANCING A CURRENT CONTROLLER

[75] Inventor: Rupert Fackler, Pleidelsheim, Germany

[73] Assignee: Robert Bosch GmbH, Stuttgart, Germany

[21] Appl. No.: 09/104,012

[22] Filed: Jun. 24, 1998

[30] Foreign Application Priority Data

Jun. 24, 1997 [DE] Germany ..... 197 26 773

[51] Int. Cl.[6] ..... G05F 1/40

[52] U.S. Cl. ..... 323/283; 323/273; 323/284

[58] Field of Search ..... 323/273, 283, 323/284, 285

[56] References Cited

U.S. PATENT DOCUMENTS 4,278,930 7/1981 Rogers ..... 323/285

4,438,498 3/1984 Sekel et al. ..... 323/283

5,572,111 11/1996 Dressler et al. ..... 323/273

5,734,259 3/1998 Sisson et al. ..... 323/282

FOREIGN PATENT DOCUMENTS 3727122 2/1989 Germany ..... G05F 1/10

*Primary Examiner*—Peter S. Wong

*Assistant Examiner*—Bao Q. Vu

*Attorney, Agent, or Firm*—Walter Ottesen

[57] ABSTRACT

The invention is directed to a method for balancing a current controller for controlling a current. The current controller is configured to adjust the current to a desired value of current while considering an actual value of the current determined by a measurement. The current controller is balanced while considering the deviation between the real magnitude of the current and the actual value applied to adjust the current.

8 Claims, 2 Drawing Sheets

METHOD FOR BALANCING A CURRENT CONTROLLER

FIELD OF THE INVENTION

The invention relates to a method for balancing a current controller which can adjust a current to a desired value while considering an actual value determined by a measurement.

BACKGROUND OF THE INVENTION

A method of this kind is, for example, disclosed in German patent publication 3,727,122. This publication describes a control apparatus which is intended to ensure that an actuator, such as an idle actuator, of an internal combustion engine is provided with current of a specific magnitude flowing therethrough. This magnitude of the current is determined by a current controller accommodated in a control apparatus. This current controller continuously adjusts the current so that its magnitude corresponds to a particular desired value while considering an actual value determined utilizing a measurement resistor. However, the current adjusted in this manner deviates frequently from the desired value of the current especially because of deviations of the resistance value of the measurement resistor. A balancing of the current controller is conducted in order to prevent such deviations. For this purpose, a balancing computer is connected to the control apparatus and inputs a desired value for the current to the control apparatus and then determines the deviation between this desired value and the magnitude of the current to be actually adjusted in response thereto. The real magnitude of the current is determined from the voltage drop on a calibrated current measurement resistor utilized in lieu of the actuator. The deviation, which is determined by the balancing computer, is given to the control apparatus and is there stored in the form of a corrective factor. In normal operation of the control apparatus, the desired value, which is to be supplied to the current controller, is multiplied by the corrective factor before it is used.

Experience has shown that a current controller balancing of this kind does not always lead to the desired result. More specifically, even with the use of a current controller, which is balanced as described, differences between the desired value and the real magnitude of the current can occur which are no longer tolerable. The above notwithstanding, the balancing has been shown to be complicated and subject to error especially because of the provision of the described balancing computer.

SUMMARY OF THE INVENTION

It is an object of the invention to provide a method for is adjusting a current controller which is so improved that a reliable, precise balancing of the current controller can be made.

The method of the invention is for balancing a current controller for controlling a current. The current controller functions to adjust the current to a desired value of current while considering an actual value of the current determined by a measurement. The method includes the steps of balancing the current controller while considering the deviation between the real magnitude of the current and the actual value applied to adjust the current.

According to the method, the balancing is carried out while considering the deviation between the actual value of the current, which is supplied for the adjustment thereof, and the actual magnitude of the current.

The deviation between the actual value of the current, which is supplied for adjusting the same, and the actual magnitude of the current is usually the only reason that the actual magnitude of the current does not correspond to the desired value (more specifically, the driving of the current controller does not correspond to the actual conditions). An optimal balancing is made possible by the direct and essentially exclusive consideration of this deviation when balancing the current controller. Different than heretofore, the balancing is not influenced by circumstances, which are responsible for a possibly present defective adjustment. Especially, the balancing is not influenced by the following: the instantaneous peak of the supply voltage, the control algorithm of the current controller and/or the magnitude of the load through which current flows.

The above notwithstanding, the balancing can also be carried out in a simple manner. What is important is not the absolute magnitudes of the values which are juxtaposed but only on the deviations between these values.

With the invention, a method is provided which permits a reliable precise balancing of the current controller in a simple manner.

BRIEF DESCRIPTION OF THE DRAWINGS

The invention will now be described with reference to the drawings wherein.

DESCRIPTION OF THE PREFERRED EMBODIMENTS OF THE INVENTION

The current controller, which is to be balanced in the example described, is a component of a control apparatus of a motor vehicle. The current outputted by the current controller should be a clocked direct current. The electrical consumer or the load through which this current flows should be an actuator in this example. It is understood that the application of the invention is not limited hereto The invention is basically suitable for balancing current controllers which are provided for any desired purpose in any desired equipment and operating in any desired manner.

The arrangement shown in FIG. 1 and the balancing thereof will now be described.

Figure 1:
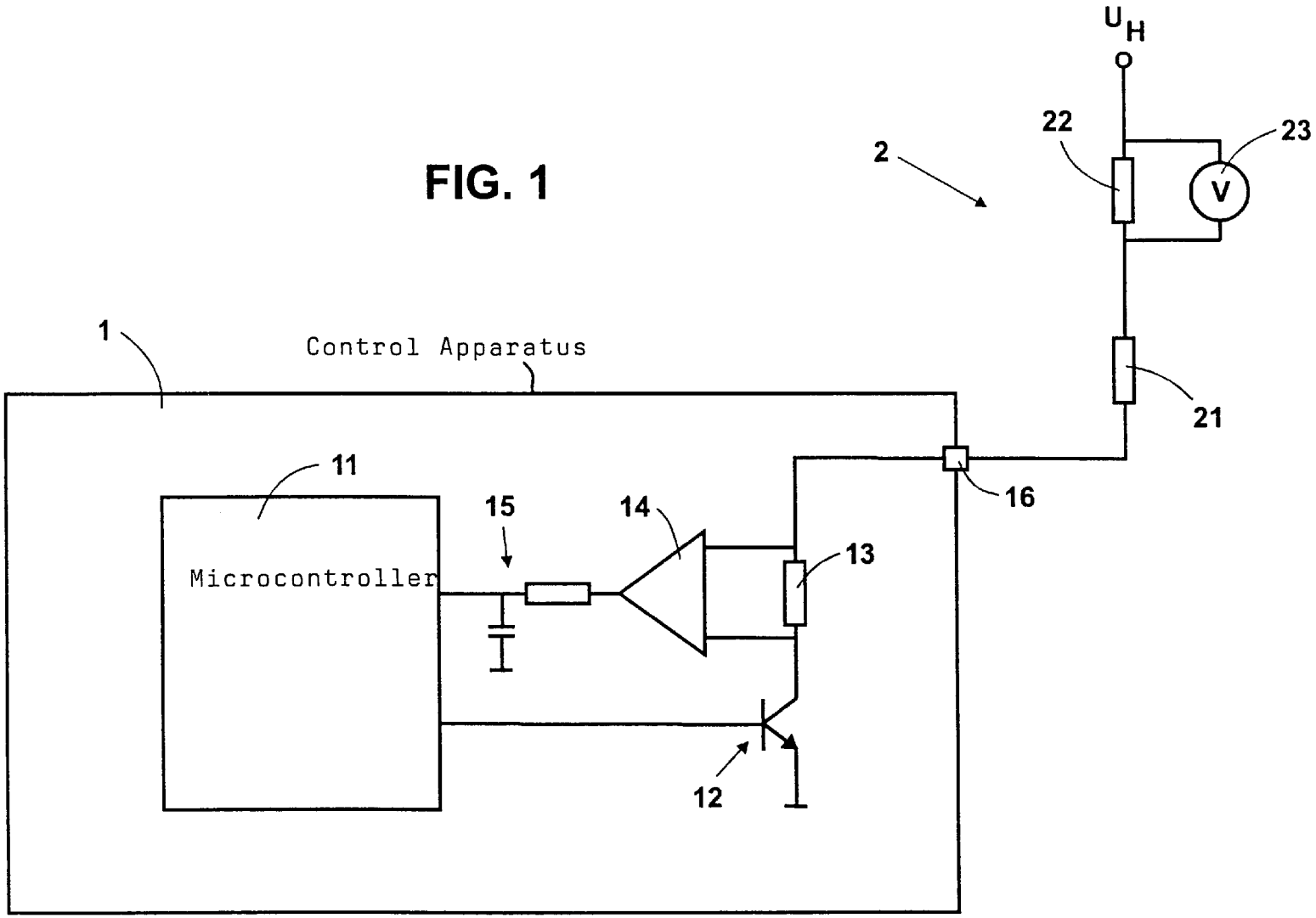
FIG. 1 is a first arrangement suitable for carrying out the method of the invention; and, FIG. 2 is a second arrangement suitable for carrying out the method of the invention.

The control apparatus 1 shown in FIG. 1 includes the current controller to be balanced. The control apparatus also includes, inter alia, the following: a microcontroller 11, a transistor 12, a measurement resistor 13, a differential amplifier 14 and a lowpass filter 15. The lowpass filter 15 comprises a resistor 3 and a capacitor 4. The microcontroller 11 and the transistor 12 conjointly define, when interacting, the current controller to be balanced.

The actuator (through which the current flows which is closed-loop controlled by the current controller) is connected via a terminal 16 of the control apparatus 1 to the latter during the normal operation of the arrangement of FIG. 1. The actuator is not connected to the control apparatus 1 during the balancing of the current controller. For this reason, the actuator is not shown in FIG. 1.

A measurement circuit 2 is connected to the control apparatus 1 in lieu of the actuator during balancing The measuring circuit 2 includes an ohmic load resistor 21 and a current sensor comprising a measurement resistor 22 and a voltmeter 23.

The magnitude of the current which flows through the actuator or the measuring circuit 2 is determined by the transistor 12 or a control signal applied to the base of the transistor 12. This control signal is supplied to the transistor 12 from an output terminal of the microcontroller 11.

The time-dependent trace and/or the magnitude of the control signal is so determined in the microcontroller 11 that the magnitude of the flowing current corresponds to a desired value thereof. Whether this is the case, is determined by the comparison of the desired value to an actual value of the current determined by measurement.

This actual value of the current is determined by using the measurement resistor 13 provided in the current path. The measurement resistor 13 has a value of 0.3 Ω in the example under consideration. The voltage drop across resistor 13 is amplified by the difference amplifier 14 and, after smoothing by the lowpass filter 15, is inputted as the above actual value of the current into an analog input terminal of the microcontroller 11.

The microcontroller 11 changes the control signal, which is outputted to the transistor 12, when and as long as the desired value of the current does not correspond to the actual value thereof determined as described above. In this way, the condition should be reached that the magnitude of the flowing current corresponds to the particular desired value thereof.

This is often not the case even when the desired value of the current and the actual value thereof, which is determined as described, are brought into coincidence. For this reason, a balancing of the current controller is carried out.

This balancing is based in the present example on a deviation between the actual value of the current from the actual magnitude thereof.

The knowledge of this deviation makes possible, in a simple manner, to preclude defective closed-loop controls which are based on the condition that the desired value of the current is compared to an actual value which does not represent the actual magnitude of the flowing current (for example, because the resistance of the measurement resistor 13 does not correspond to the desired resistance).

By eliminating this source of error, the main cause for the erroneous control by the current controller is corrected.

The actual magnitude of the flowing current is determined by the measurement circuit 2 which, during the balancing, is connected to the control apparatus in lieu of the actuator to be driven by the control apparatus.

As shown in FIG. 1, the voltage drop across the measurement resistor 22 is measured in the measurement circuit 2 by the voltmeter 23. The measurement resistor 22 is a precisely calibrated resistor and can have a resistance of 1 Ω in the example under consideration (but can assume any other desired value). The voltage drop, which can be detected at this resistor via the voltmeter 23, therefore represents precisely the actual magnitude of the flowing current.

The above-mentioned load resistor 21 is in series with the measurement resistor 22. The load resistor 21 in this example has a resistance of 22 Ω and can be loaded to 50 W. This load resistor is provided so that approximately the same conditions occur when connecting the measurement circuit to the control apparatus and when connecting the "normal" load to the control apparatus. The balancing of the current controller takes place primarily while considering the deviation of the actual value of the current (which is determined in the control apparatus utilizing measurement resistor 13) from the actual magnitude of the current (determined by the measurement circuit 2). For this reason, the measurement circuit can deviate with respect to its electrical characteristics more or less from the electrical characteristics of the "normal" load, that is, of the actuator (not shown).

The actuator is driven in a clocked manner. That is, the flowing current is switched over in accordance with a predetermined plan regularly or non-regularly between two or more values.

In the above, it is assumed that, during "normal" operation, a repeated switchover of the current between a minimum value of 0 A and a maximum value of 500 mA takes place. The above-mentioned minimum value and/or the maximum value can be variably changeable values.

Independently of the foregoing, balancing, however, takes place during steady state, that is, not during clocked operation of the current controller. In this way, the necessity is eliminated to subject the balancing to a timing adapted to the time-dependent course of the current. Furthermore, balancing can be thereby carried out very quickly.

In the example under consideration, balancing is carried out only for two different current values. The first current value is close to the above-mentioned minimum value (0 A) and the second current value is close to the above-mentioned maximum value (500 mA). Stated more precisely, the deviation is determined between the actual value of the current, which is determined in the control apparatus 1 (utilizing the measurement resistor 13), and the real value of the current (determined by the measurement circuit 2). The deviation is determined at approximately 90% of the maximum value, that is, for a current flow of approximately 450 mA and at approximately 5% of the maximum value, that s, for a current flow of approximately 25 mA.

The determination of the deviation for only two current values is adequate when and so long as the current only assumes these values (or values close thereto) or can assume only these values. The same applies when a linear or a known non-linear trace of the deviation to be determined can be expected between the measuring points. Then, the deviation can be determined by interpolation for other points which lie therebetween or close thereto.

For an unknown course of the deviations, many additional measuring points can be provided. Indeed, so many can be provided that at least approximately a linear or other known deviation trace occurs between mutually adjacent measuring points.

Performing the balancing at only a few points makes it possible to undertake the entire balancing operation within the shortest time.

The differently large current flows, for which the balancing of the current controller is carried out, are generated by a corresponding switchover of the quantity of the ancillary voltage $U_H$ for the arrangement according to FIG. 1 The voltage $U_H$ is applied to the measuring circuit 2 from a voltage source external to the control apparatus 1.

In the example under consideration, the sought after current flow of 450 mA at $U_H$=10.3 V and the sought after current flow of 25 mA at $U_H$=0.57 V is obtained.

The deviations, which are determined for these current flows, are between the actual value of the current, which is determined in the control apparatus while utilizing the measurement resistor 13, and the real value (determined via the measurement circuit 2) of the current (or quantities which represent these deviations) are stored in the control apparatus 1 and are used in normal operation to eliminate the above deviations The elimination takes place in the simplest case in that the deviations are corrected with the actual values in advance of their use. These actual values are determined in the control apparatus 1 while using the measurement resistor 13 and the deviations are computed by interpolation or determined during balancing. The magnitude of the particular actual value determines which of the deviations is corrected therewith.

It does not require an explanation that a plurality of alternatives exists for evaluating the deviations, which are determined by balancing.

Figure 2:
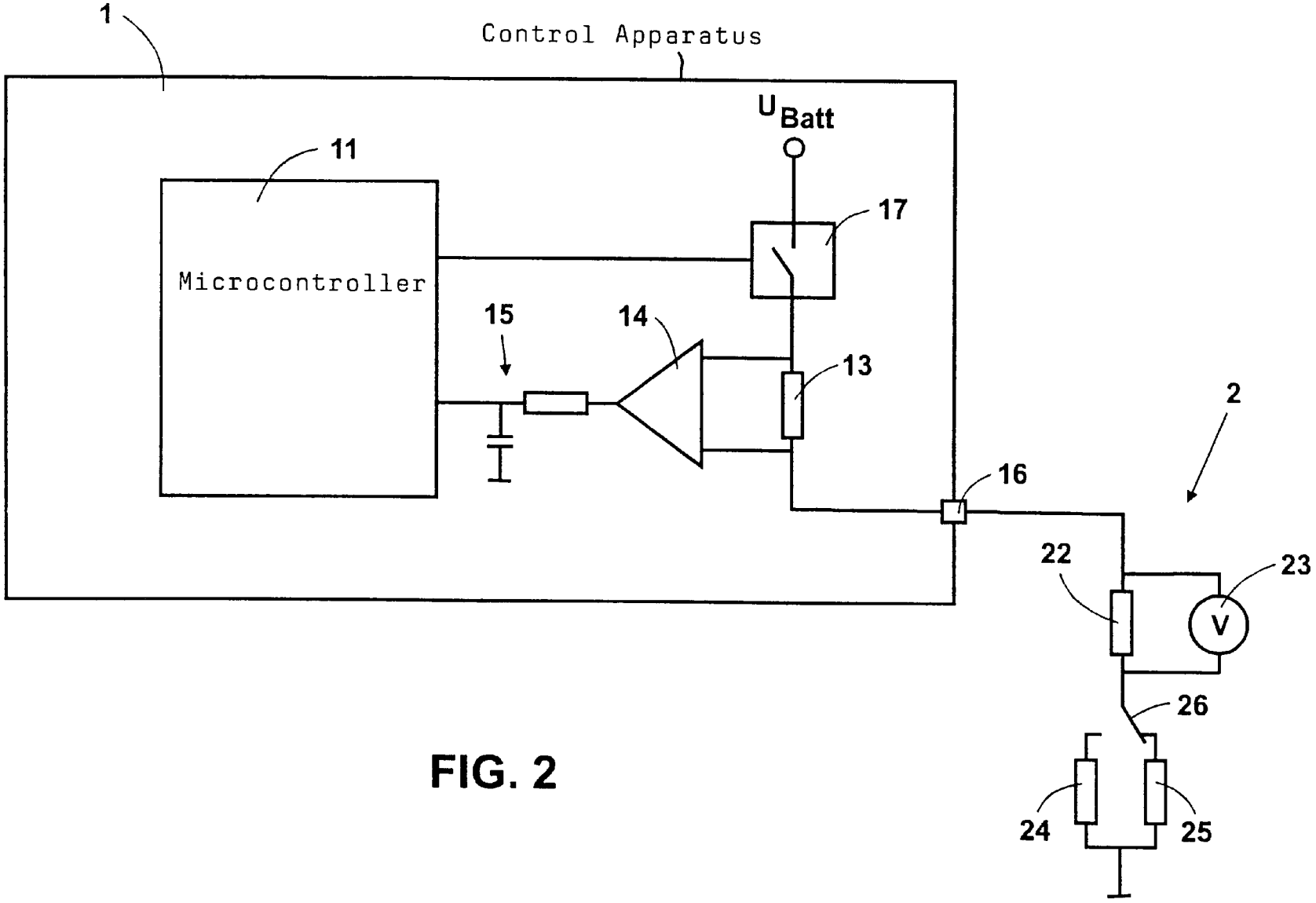

A further arrangement for carrying out balancing of a current controller while considering the deviation between the actual value and the real magnitude of the current is shown in FIG. 2. The actual value is applied for adjusting the current.

The arrangement of FIG. 2 corresponds substantially to the arrangement of FIG. 1. The same elements of FIG. 2 which correspond to those of FIG. 1 are identified by the same reference numerals.

The arrangement of FIG. 2 again includes a control apparatus 1 which controls an actuator (not shown). More precisely, the control apparatus 1 controls the current flowing through the actuator.

The control apparatus 1 includes, inter alia, a microcontroller 11, a driver 17 (which corresponds in its operation to transistor 12), a measurement resistor 13, a differential amplifier 14 and a lowpass filter 15 comprising a resistor 3 and a capacitor 4. The microcontroller 11 and the driver 17 coact to define the current controller to be balanced.

The actuator through which current, which is controlled by the current controller, is to flow) is connected to the control apparatus 1 via a terminal 16 during normal operation of the arrangement of FIG. 2. The actuator is not connected to the control apparatus during the balancing of the current controller For this reason, the actuator is not shown in FIG. 2.

In lieu of the actuator, a measurement circuit 2 is connected to the control apparatus 1 during balancing This measurement circuit 2 replaces the ohmic load resistor 21 of FIG. 1 and includes the following: load resistors 24 and 25, which have different resistance values; a switching device 26 for switching over between the load resistors 24 and 25; and, an ammeter comprising a measurement resistor 22 and a voltmeter 23.

The magnitude of the current (which flows through the actuator or through the measuring circuit 2) is determined by the driver 17, that is, by a control signal supplied to the driver 17 from an output terminal of the microcontroller 11.

The time-dependent trace and/or the magnitude of the control signal is so determined in the microcontroller 11 that the magnitude of the flowing current corresponds to a desired value thereof. Whether this is the case, is determined by the comparison of the desired value to an actual value of the current determined by measurement.

The actual value of the current is, in turn, determined utilizing the measurement resistor 13 provided in the current path. The voltage drop, which appears across this resistor, is amplified by the difference amplifier 14 and, after smoothing by the lowpass filter 15, is inputted to the analog input terminal of the microcontroller 11 as the above-mentioned actual value of the current.

The microcontroller 11 changes the control signal outputted to the transistor 12 when, and so long as the desired value of the current does not correspond to the actual value of current determined as described above. In this way, it is achieved that the magnitude of the flowing current corresponds to the particular desired value thereof.

For the reasons set forth with respect to the description of FIG. 1, a balancing of the current control is here also required. As in FIG. 1, this balancing is based on deviations between actual values of different size currents and the respective real magnitudes of these currents.

The real magnitudes of the respective flowing currents are, in turn, determined via the measurement circuit 2. This circuit is, as mentioned above, connected to the control apparatus 1 during balancing in lieu of the actuator to be controlled by the control apparatus.

The measurement of the real magnitudes of the current and the determination of the deviations between these currents and the actual values thereof (which are determined utilizing the measurement resistor 13) and the evaluation of the deviations in normal operation of the arrangement shown in FIG. 2 do not distinguish from the steps carried out with respect to the arrangement of FIG. 1.

The balancing is here also carried out with two current flows of different magnitude.

As a difference to the measuring circuit of FIG. 1, the current flows of different magnitude are effected not by a switchover of the supply voltage but by switching in load resistors of different magnitude into the current path.

In the example under consideration, the switchover takes place via the switching device 26. With this device, the load resistor 24 or the load resistor 25 can be selectively switched into the current path.

The resistances of the load resistors 24 and 25 are so dimensioned that, in one case, a current flow of approximately 25 mA occurs and, in another case, a current flow of approximately 450 mA.

The deviations determined for these current flows between the actual value of the current (determined in the control apparatus 1 utilizing the measurement resistor 13) and the real value of the current determined by the measurement circuit 2) are stored in the control apparatus 1, that is, in microcontroller 11 and are used in normal operation to eliminate the above-mentioned deviation.

The current controller balancing in the arrangement of FIG. 1 and the arrangement of FIG. 2 lead to the same result in a different manner.

The current controller balancing in the arrangement of FIG. 2 is more universally usable because no intervention on the voltage must take place which is applied to the measuring circuit 2 during the balancing. This has been shown to be especially advantageous when the measuring circuit 2 is connected via the control apparatus to the non-grounded pole of the supply voltage source (battery).

With the arrangements according to the invention and the methods for current controller balancing, a reliable and precise current controller balancing can be carried out in a simple manner and exceedingly rapidly.

it is understood that the foregoing description is that of the preferred embodiments of the invention and that various changes and modifications may be made thereto without departing from the spirit and scope of the invention as defined in the appended claims.

What is claimed is:

1. A method for balancing a current controller for controlling a current, the current controller functioning to adjust the current to a desired value of current while considering an actual value of the current determined by a first measurement, the method comprising the steps of:

comparing the deviation between the real magnitude of the current determined by a second measurement and the actual value applied to adjust the current;

storing said deviation in said current controller; and, using the stored deviation in normal operation.

2. The method of claim 1, comprising the further steps of:

providing a measurement resistor arranged in the current path and possibly burdened with tolerances; and, determining said actual value by using said measurement resistor.

3. The method of claim 1, comprising the further steps of:

providing a measurement circuit including a calibrated resistor; and, determining the real magnitude of the current via said measurement circuit.

4. The method of claim 3, wherein said current controller provides current to a load with said current being adjusted by said current controller; and, wherein the method comprises the step of using said measurement circuit in lieu of said load.

5. The method of claim 4, comprising the further step of determining the deviation for at least two current flows having respectively different magnitudes.

6. The method of claim 5, wherein a voltage is applied to said measurement circuit; and, the method comprising the further step of effecting said current flows of respectively different magnitudes by adjusting said voltage.

7. A method for balancing a current controller for controlling a current, the current controller functioning to adjust the current to a desired value of current while considering an actual value of the current determined by a measurement, the method comprising the steps of:

balancing said current controller while considering the deviation between the real magnitude of the current and the actual value applied to adjust the current;

providing a measurement circuit including a calibrated resistor;

determining the real magnitude of the current via said measurement circuit;

said current controller providing current to a load with said current being adjusted by said current controller;

using said measurement circuit in lieu of said load;

determining the deviation for at least two current flows having respectively different magnitudes;

applying a voltage to said measurement circuit;

effecting said current flows of respectively different magnitudes by adjusting said voltage; and, sequentially connecting at least two load resistors of respectively different resistance values to said current controller to cause said current flows.

8. The method of claim 7, comprising the further step of correcting the stored deviation with said actual value or other magnitude.

* * * * *

UNITED STATES PATENT AND TRADEMARK OFFICE

CERTIFICATE OF CORRECTION

PATENT NO. : 5,973,488
DATED : October 26, 1999
INVENTOR(S) : Rupert Fackler

It is certified that error appears in the above-identified patent and that said Letters Patent is hereby corrected as shown below:

Column 1,
Line 52, delete "is" (second occurrence).

Column 2,
Line 42, delete "hereto" and "The" and substitute -- hereto. The -- therefor;
Line 64, delete "balancing The" and substitute -- balancing. The -- therefor.

Column 4,
Line 33, delete "s," and substitute -- is, --therefor;
Line 54, delete "1 The" and substitute -- 1. The -- therefor;
Line 67, after "deviations", add -- . --.

Column 5,
Line 32, delete "through" and substitute -- (through -- therefor;
Line 37, delete "controller For" and substitute -- controller. For -- therefor;
Line 41, delete "balancing This" and substitute -- balancing. This -- therefor.

UNITED STATES PATENT AND TRADEMARK OFFICE

CERTIFICATE OF CORRECTION

PATENT NO. : 5,973,488
DATED : October 26, 1999
INVENTOR(S) : Rupert Fackler

It is certified that error appears in the above-identified patent and that said Letters Patent is hereby corrected as shown below:

Column 6,
Line 38, delete "determined" and substitute -- (determined -- therefor;
Line 57, delete "it" and substitute -- It -- therefor.

Signed and Sealed this

Seventh Day of August, 2001

*Attest:*

Nicholas P. Godici

*Attesting Officer*

NICHOLAS P. GODICI
*Acting Director of the United States Patent and Trademark Office*